US007234857B2

(12) United States Patent
Matula

(10) Patent No.: US 7,234,857 B2
(45) Date of Patent: Jun. 26, 2007

(54) METHOD AND APPARATUS FOR FEEDING A CHEMICAL INTO A LIQUID FLOW

(75) Inventor: Jouni Matula, Savonlinna (FI)

(73) Assignee: Wetend Technologies Oy, Savonlinna (FI)

( * ) Notice: Subject to any disclaimer, the term of this patent is extended or adjusted under 35 U.S.C. 154(b) by 74 days.

(21) Appl. No.: 10/127,701

(22) Filed: Apr. 23, 2002

(65) Prior Publication Data

US 2002/0131325 A1 Sep. 19, 2002

Related U.S. Application Data

(63) Continuation-in-part of application No. 09/622,872, filed as application No. PCT/FI99/00145 on Feb. 24, 1999, now Pat. No. 6,659,636.

(30) Foreign Application Priority Data

Feb. 26, 1998 (FI) ..... 980437
Feb. 24, 1999 (FI) ..... PCT/FI99/00145

(51) Int. Cl.
*B01F 15/02* (2006.01)

(52) U.S. Cl. ..... 366/167.1; 366/177.1; 366/173.1

(58) Field of Classification Search ..... 366/165.1, 366/165.2, 178.1, 178.2, 181.5, 181.6, 167.1, 366/173.1, 173.2, 177.1
See application file for complete search history.

(56) References Cited

U.S. PATENT DOCUMENTS 945,143 A * 1/1910 Szamek ..... 366/178.1
1,496,345 A * 6/1924 Lichtenthaeler
2,021,092 A * 11/1935 Teliet ..... 366/181.5
2,653,801 A * 9/1953 Fontein et al.
2,831,754 A * 4/1958 Manka ..... 366/178.1
3,152,117 A * 10/1964 Eijsberg
3,251,653 A * 5/1966 Aditya
3,376,023 A * 4/1968 Lage ..... 366/178.1
3,502,103 A * 3/1970 Verschuur ..... 137/565.33
3,582,047 A * 6/1971 Greene ..... 366/178.1
3,697,051 A * 10/1972 Lachman et al. ..... 366/178.1
3,794,299 A * 2/1974 Wagner et al.
3,847,375 A * 11/1974 Kuerten et al. ..... 366/178.3
4,053,142 A * 10/1977 Johannes
4,092,013 A * 5/1978 Staaf
4,270,576 A * 6/1981 Takeda et al.
4,419,109 A * 12/1983 Matula
4,498,819 A * 2/1985 El-Saie
4,519,423 A * 5/1985 Ho et al.
4,538,921 A * 9/1985 Kennedy ..... 366/178.3
4,586,825 A * 5/1986 Hayatdavoudi
4,673,006 A * 6/1987 Speck (Continued)

FOREIGN PATENT DOCUMENTS

| | | | |
|---|---|---|---|
| EP | 0 270 103 | | 6/1988 |
| EP | 0 389 201 | * | 9/1990 |
| EP | 0 450 788 | * | 10/1991 |
| EP | 0 541 457 | | 5/1993 |
| EP | 0 745 463 | | 12/1996 |
| GB | 378024 | * | 8/1932 |
| GB | 2 292 158 | | 2/1996 |
| WO | WO 91/02119 | | 2/1991 |

*Primary Examiner*—Tony G. Soohoo
(74) *Attorney, Agent, or Firm*—Nixon & Vanderhye, P.C.

(57) ABSTRACT

A method of and apparatus for feeding a chemical into a liquid flow are especially suited for use with a headbox of a paper machine, particularly for feeding a retention aid into a fiber suspension flow going to the headbox so that in a mixing apparatus feed liquid is added into the retention chemical solution, prior to introducing the solution into the fiber suspension flow guided to the paper machine. The feed liquid is preferably a circulation water from the paper mill, or another non-clean liquid from a paper mill.

24 Claims, 10 Drawing Sheets

Figure 2:
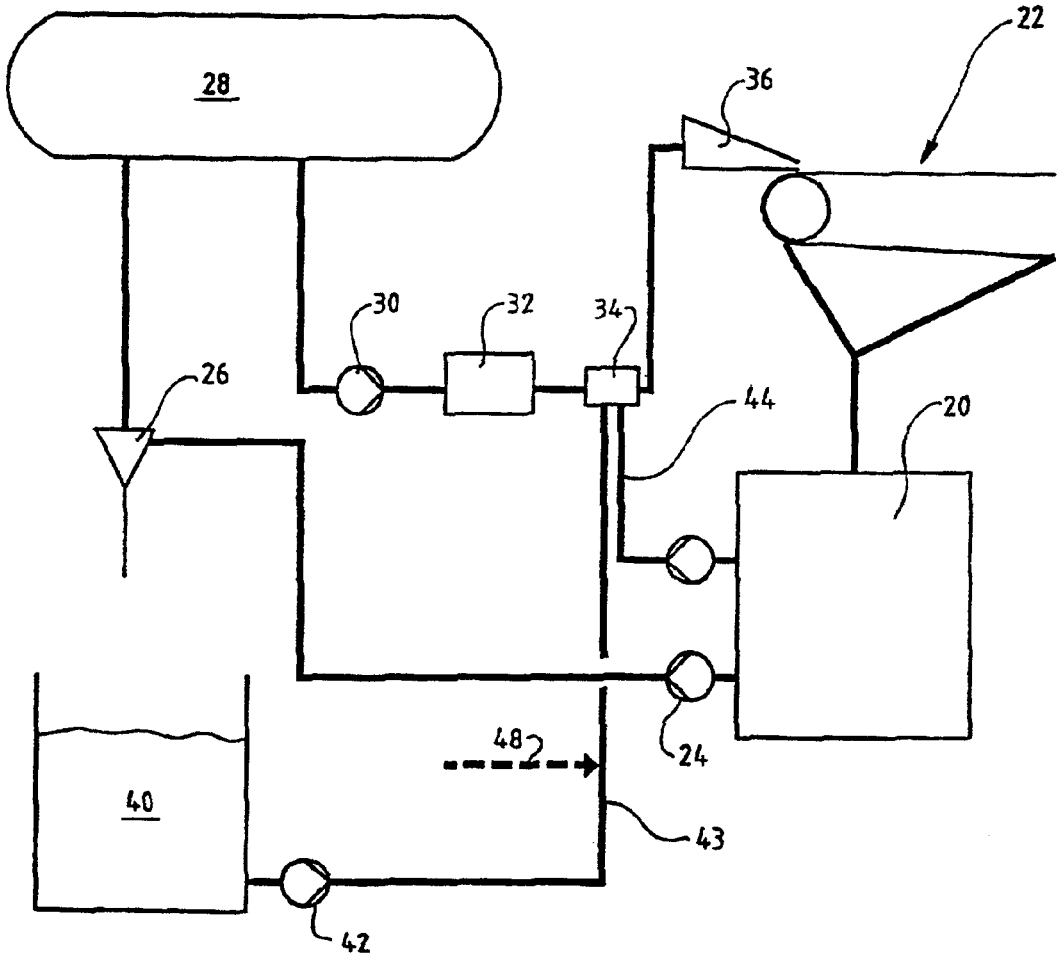

U.S. PATENT DOCUMENTS 4,705,405 A * 11/1987 Williams
4,726,686 A * 2/1988 Wolf et al.
4,753,535 A * 6/1988 King
4,761,077 A * 8/1988 Werner
4,781,467 A * 11/1988 Williams
4,790,666 A * 12/1988 Koziol
4,834,343 A * 5/1989 Boyes
4,861,165 A * 8/1989 Fredriksson et al.
4,889,594 A * 12/1989 Gavelin ..... 162/123
4,913,775 A 4/1990 Langley et al.
4,999,131 A * 3/1991 Shimizu et al.
5,118,197 A * 6/1992 Ellenberger
5,356,213 A * 10/1994 Arpentinier
5,387,401 A * 2/1995 Kendili
5,466,063 A * 11/1995 Poyet et al.
5,653,801 A * 8/1997 Chen et al.
5,705,060 A * 1/1998 Robberts
5,806,976 A * 9/1998 Roque
5,865,537 A * 2/1999 Streiff et al. ..... 366/181.5
6,125,688 A * 10/2000 Matula
6,368,462 B1 * 4/2002 Lumiala et al.
6,749,330 B2 * 6/2004 Allen ..... 366/178.2

* cited by examiner

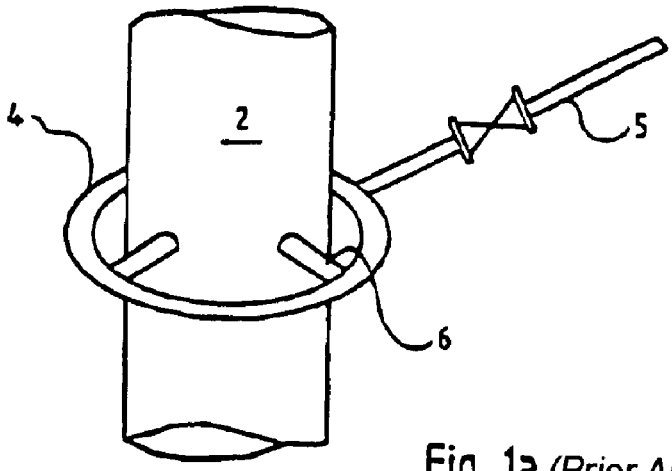
Fig. 1a *(Prior Art)*
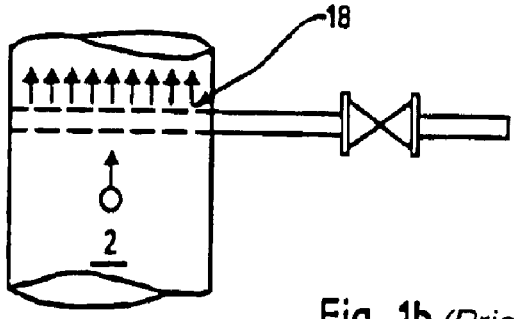
Fig. 1b *(Prior Art)*
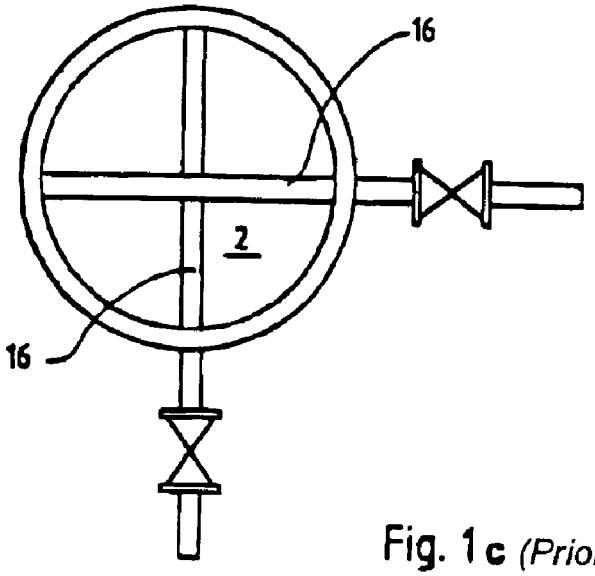
Fig. 1c *(Prior Art)*

METHOD AND APPARATUS FOR FEEDING A CHEMICAL INTO A LIQUID FLOW

This application is a continuation-in-part of application Ser. No. 09/622,872, filed 24 Aug. 2000, now U.S. Pat. No. 6,659,636 the entire content of which is hereby incorporated by reference in this application such is a national stage of PCT/FI99/00145 filed Feb. 24, 1999.

The present invention is related to a method and apparatus for feeding a chemical into a liquid flow. The method and apparatus of the invention are particularly well applicable to homogeneous adding of a liquid chemical into a liquid flow. Preferably the method and apparatus according to the invention are used for feeding a retention aid into fiber suspension going to the headbox of a paper machine.

Naturally, there is practically an innumerable amount of prior art methods of feeding various chemicals into liquid flows. These methods may be divided into a few main categories, though, as seen from the following. Firstly, it is quite possible to just let the liquid to be added flow freely into a second liquid without employing any special regulation or mixing means. This method of adding cannot be employed in situations where the mixing ratio or homogeneity is of significance. Neither can it be employed in situations where the price of the chemical to be added is of significance. The next applicable method is to feed the chemical in a strict proportion to the liquid flow, whereby correct and economical proportioning is obtained. However, even in this case one has to take into account that usually the proportion of the chemical is slightly excessive compared to the optimal proportioning, because the mixing is known to be inadequate. The mixing may be improved, though, by feeding the chemical e.g. through a perforated wall of a flow channel, whereby the chemical to be mixed may at least be spread throughout the liquid flow. Lastly, a situation may be considered, where the chemical is fed in a strict proportion either into the liquid flow on the upper-flow side of the mixer or through the mixer itself into the liquid. In that case, the efficiency of the mixing of the chemical into the liquid flow is totally dependent on the mixer design.

Papermaking is in its own way a very demanding special field when chemical mixing is concerned. When using paper chemicals, it is good to bear in mind that their precise and homogeneous mixing is of vital importance in the short circulation of a paper machine. Homogeneous mixing means in a direct sense better quality and homogeneity of paper. At the same time, the process may be carried out without disturbances and problems. Poor mixing, on the other hand, requires chemical overdosing, which may increase the production costs remarkably. It is self-evident that in case of poor mixing, the quality of the paper and the operation of the process are not satisfactory. The existing mixing technique utilizes, on the one hand, clean water fractions both as dilution waters and as so-called feeding liquid which is used in order to intensify the mixing. On the other hand, efforts are made to close the water circulations of paper mills, whereby the feeding dosage of clean water into the system should be decreased, and internally clarified fractions or some non-treated direct flow from the process, such as e.g. filtrates, should be used instead. The existing systems for the mixing of chemicals do not allow or allow only to a small extent the use of water fractions of internal processes.

An essential case of mixing relating to paper manufacture is the mixing of a retention aid into fiber suspension flow going to the headbox of a paper machine. In paper manufacture, retention chemicals are used especially in order to improve the retention of fines at the wire part of the paper machine. As retention aid a chemical is used, long molecular chains of which bind together solid matter particles of the pulp and thus prevent the fines from passing, during the web formation stage, together with water through the wire. The retention aid should be mixed into the pulp as homogeneously as possible in order to gain the maximum effect of the chemical and to avoid variation of paper characteristics caused by retention fluctuations. Mixing, on the other hand, means that the liquid is subjected to a turbulent flow, the shearing forces of which break/may break long molecular chains, which naturally weakens the effect of the retention aid. Nevertheless, there are different kinds of retention aids. Sensitive to the effects of a turbulent flow are, e.g., polyacrylic amides, broken molecular chains of which are not known to be restored to their former length after the turbulence has attenuated, but there are also retention aids (e.g. polyethyleneimines), molecular chains of which are restored to their essentially original length shortly after the turbulence has attenuated.

In the short circulation of a paper machine, the feed point of the retention aid depends to a great extent on the retention aid used, the state of the flow from the feed point to the headbox lip, and the pulp used. The introduction of retention aids sensitive to shearing forces usually takes place immediately after a means (that may be a pump, a screen or a centrifugal cleaner) that causes shearing forces and is placed prior to the headbox, the feeding being carried out either into one spot or e.g. into the accept pipe of each pressure screen. It is also possible to use several retention aids of various types at the same time and introduce them into the fiber suspension by stages. The part of retention aids which is resistant to shearing forces may be fed as early as into the high-consistency pulp or prior to the headbox feed pump, and the part of retention aids which is sensitive to shearing forces is usually introduced not until the fiber suspension feed pipe prior to the headbox.

At present, as feeders of retention aids two types of apparatus are mainly used. A simpler apparatus (FIG. 1*a*) comprises an annular manifold placed around the pulp flow channel in a distance therefrom, connected by a number of feed pipes (at least four feed pipes) with the pulp flow channel so that the retention aid is discharged via said feed pipes in an even flow to the pulp flowing in the channel. A second possibility (FIGS. 1*b* and 1*c*) is to take e.g. two feed pipes crosswise through the flow channel and provide the part of the feed pipes which is left inside the flow channel with retention aid feed holes or slots, through which the retention aid flows in an even stream into the pulp, whereby the mixing result is to some extent better. At present, retention aids are fed into the fiber suspension flow under a relatively small pressure difference, whereby the retention aids form their own flow channels or at least a distinct danger exists that they are channeled inside the fiber suspension flow. In other words, in retention aid feeding it is commonly presumed that after the feeding point of the chemical there is a mixing apparatus that mixes the chemicals homogeneously into the fiber suspension. On the other hand, the amount of retention aid that is fed into the fiber suspension is chiefly based on practical knowledge from experience. This means that in practice retention aids are mixed into fiber suspension in an amount big enough to ensure the desired effect. In fact, this means a remarkable over-dosing of retention chemicals (sometimes even by tens of percents) due to not homogeneous mixing.

It is characteristic of retention aids and their introduction that the retention aids are delivered to paper mills, in addition to liquid form, also as powders which are used depending on the paper to be made and the material to be used in an amount of about 200–500 g per one paper ton. A retention aid in powder form is mixed into fresh water in a special mixing tank in a proportion of 1 kg of powder to about 200 liters of clean water. This is because retention aids are known to react with, that is to stick onto, all solid matter particles in the flow very quickly, in about a second, which means that the dilution liquid has to be as clean as possible. In other words, in this stage, per 1 ton of produced paper 40–100 liters of clean water is used for retention aid production. Consequently, the consumption per day is, depending on the production of the paper machine, 10–100 cubic meters (here the production is estimated to be 250–1000 tons of paper per day). Nevertheless, this first dissolution stage is not the stage where water is used at the most, as in prior art processes this retention aid solution is further diluted into, e.g., one fifth of its concentration, which in practice means that for this so-called secondary dilution 200–500 liters of clean water is used per 1 paper ton. This results in a calculated daily consumption of 50–500 cubic meters of clean water per one paper machine.

In other words, until now it has been accepted that for the dilution of the retention aid per one paper machine hundreds of cubic meters of clean water is needed per day. Nevertheless, this has to be understood as a clear drawback, especially in cases when the paper mill is known to have great amounts of various circulation waters available, which might be utilized for this purpose, too. The only precondition for the use of circulation waters is that there should be a way to prevent retention chemicals from reacting with the solid matter in the circulation waters.

On the one hand, one has to bear in mind that the short circulation of a paper machine employs, due to large amounts of liquid, large-sized pipes. For example, as a feed pipe of the headbox of a paper machine, a pipe with a diameter of about 1000 mm may be used. This is one of the reasons why mixing a relatively small additional flow, such as a diluted retention aid, homogeneously into a wide flow channel is problematic.

On the other hand, the construction of the above described, presently used retention aid feeding apparatuses is very simple. When considering their operational efficiency, i.e. the homogeneity of the mixing, one might even say that they are too simple. In other words, the simplicity of the apparatus and the feeding method of chemicals, resulting in non-homogeneous dosing and also degradation of chemical molecules, inevitably lead to remarkable overdosing of chemicals, as the basic goal inevitably is to achieve a certain wire retention on a paper machine.

A further evident problem discovered in prior art processes is connected with the most traditional way of mixing the retention aid into the fiber suspension, that is prior to the headbox screen. Because the reaction time of a retention aid was known to be short, the headbox screen was considered a magnificent place for homogeneous and quick mixing of the retention aid into the pulp. And so it was when headbox screens of old art where used, which had a hole drum as a screening member. But now, with slot drums conquering the market, it has been discovered that the retention aid is capable of forming flocks prior to the slot drum, and thus a great amount of both the retention aid and the fines of the fiber suspension otherwise usable is, at best, rejected or, at worst, clogs the fine slots of the slot drum.

As noticed from above, numerous drawbacks and disadvantages have been discovered for example in the feed of retention chemicals. For solving e.g. the above mentioned problems of prior art, a new method and apparatus have been developed, which allow feeding into the liquid flow even chemicals consisting easily degrading polymeric chains, for instance retention chemicals, so that the polymeric chains remain non-degraded to a remarkably larger extent than before. As another advantage of the method and apparatus according to the invention we may mention, e.g., a substantial decrease in the consumption of fresh water in a paper mill, when desired, and an essentially more efficient and homogeneous mixing of retention aids into the fiber suspension.

The characterizing features of the method and apparatus of the invention are defined by the appended patent claims.

Figure 3:
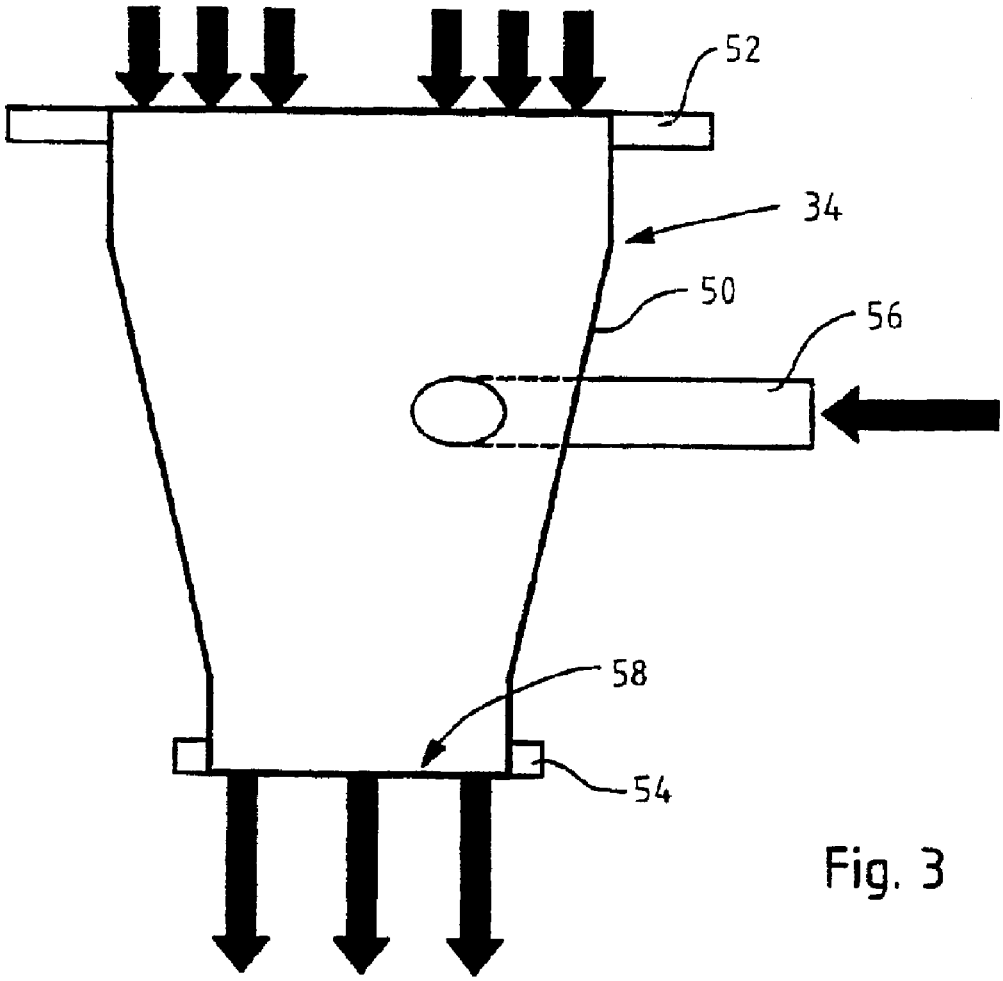
Figure 4:
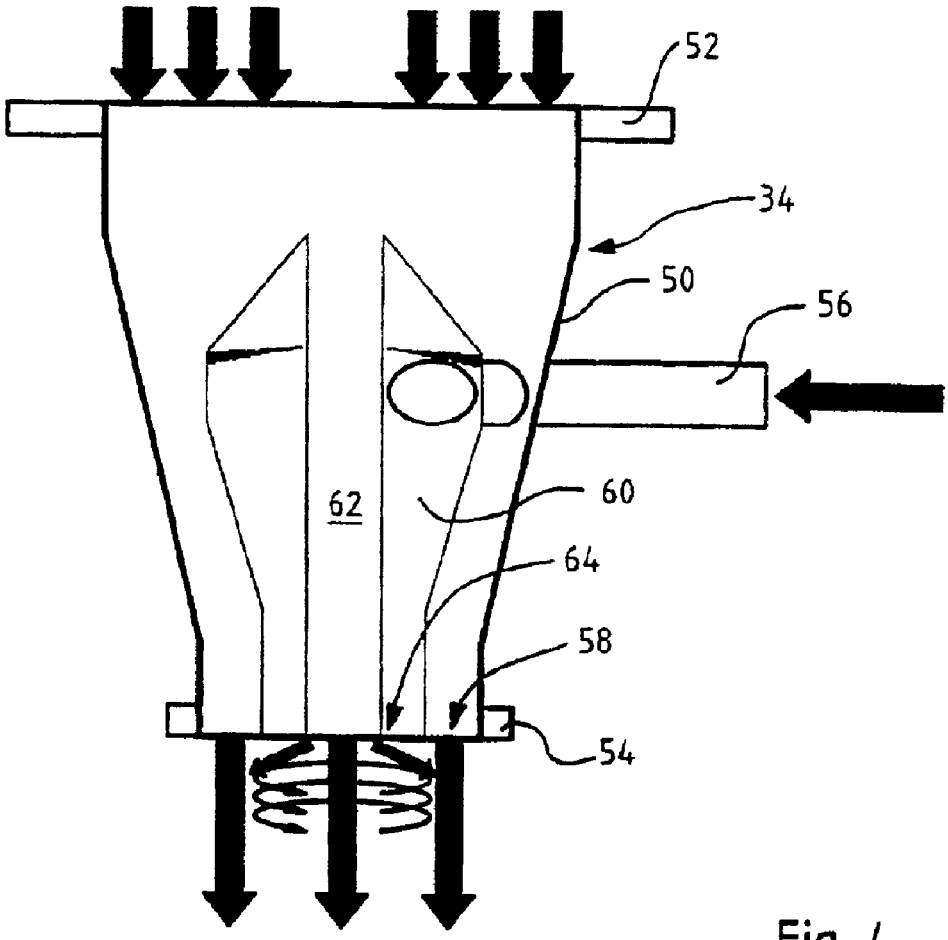
Figure 5:
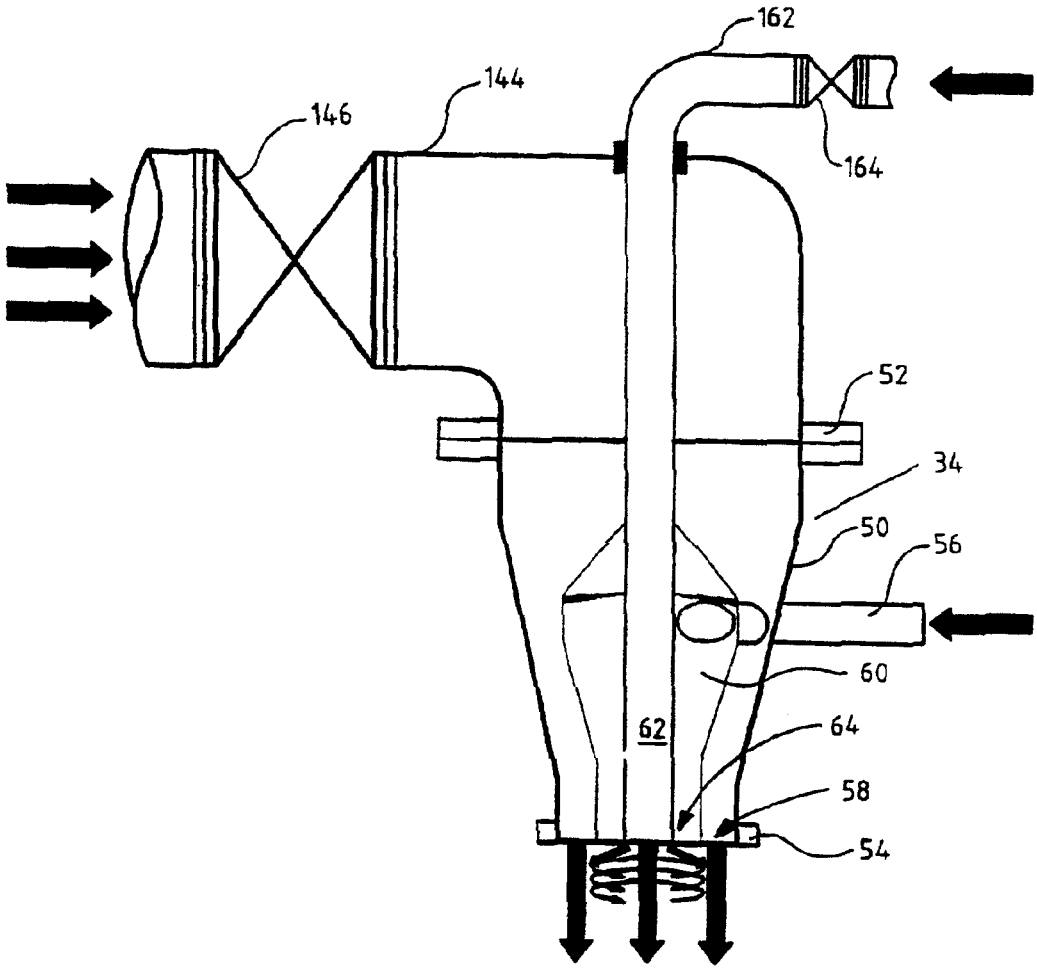
Figure 6:
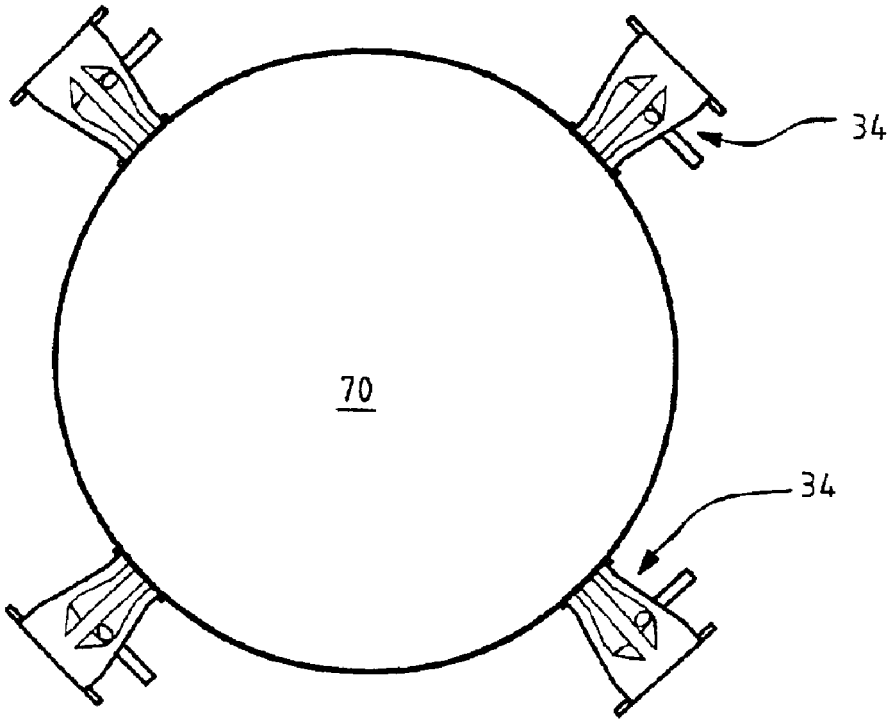
Figure 7:
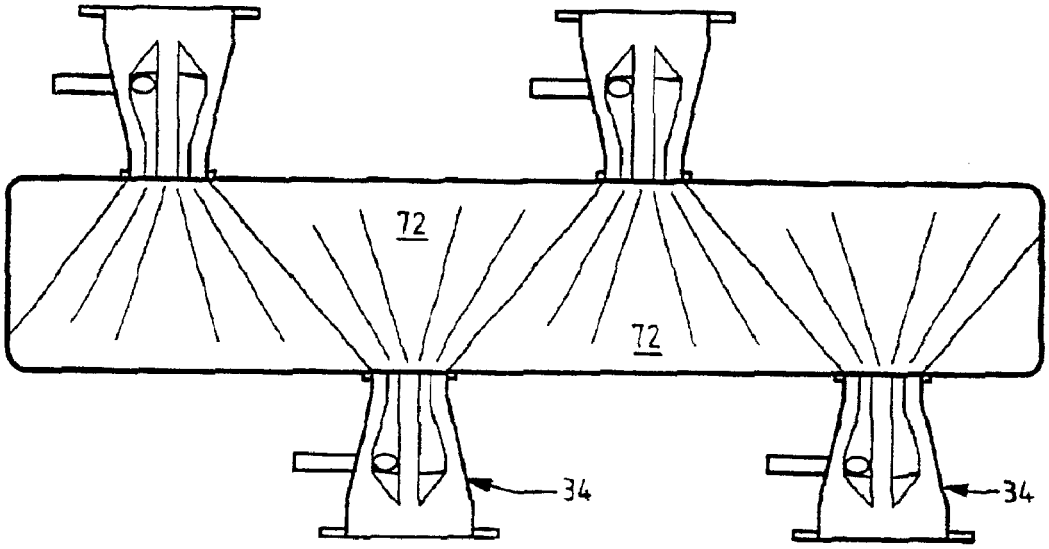
Figure 8A:
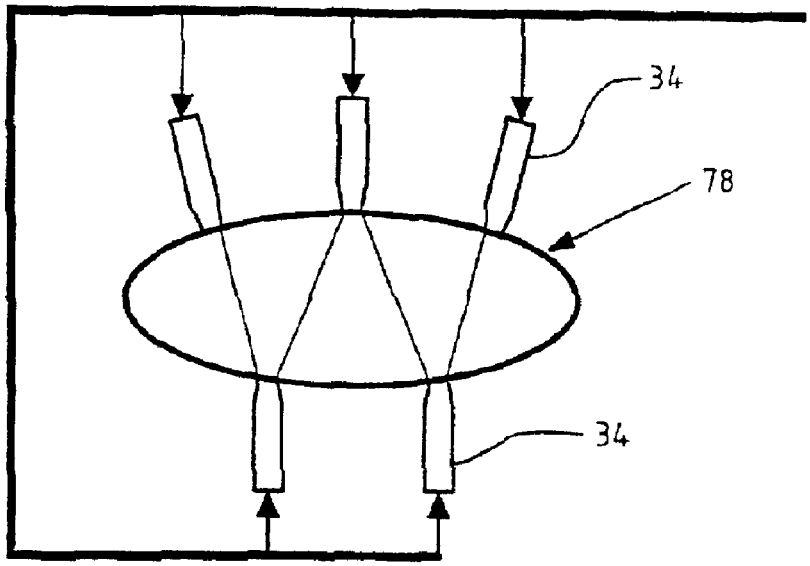
Figure 8B:
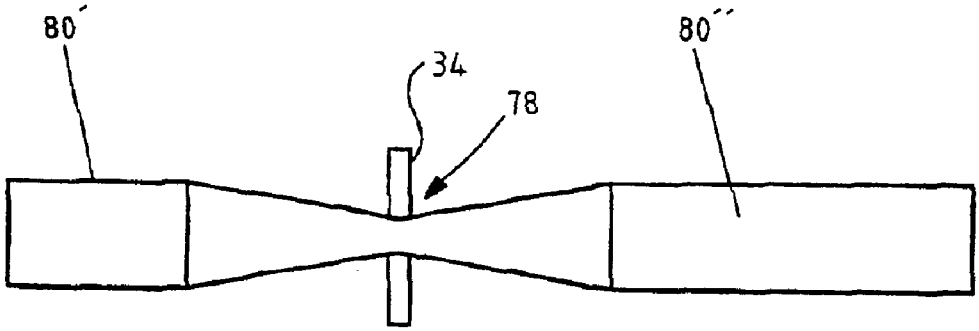
Figure 9:
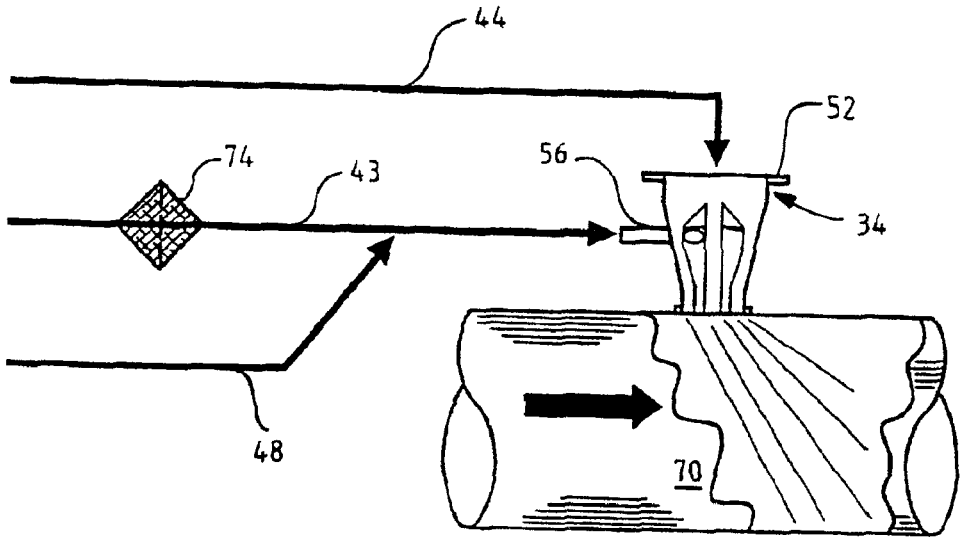
Figure 10:
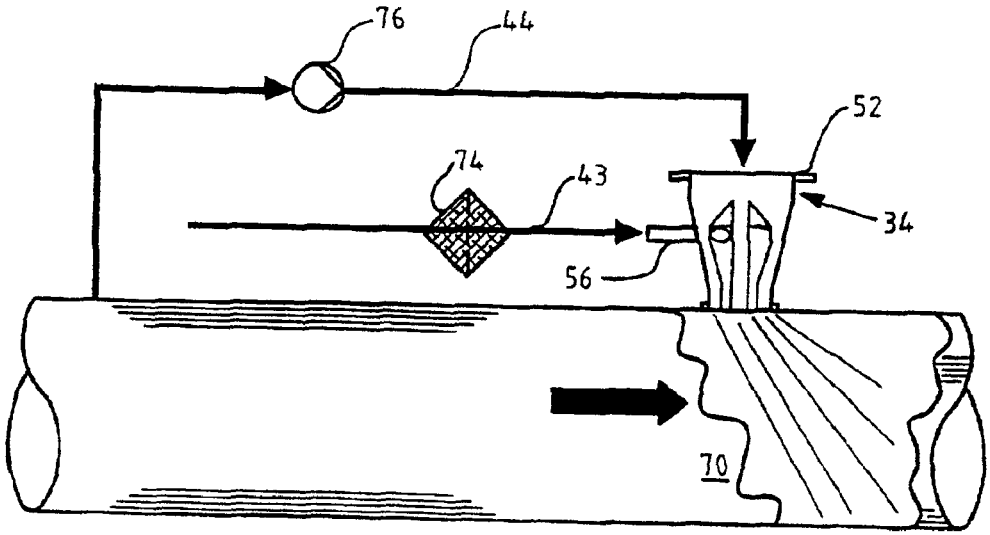
Figure 11:
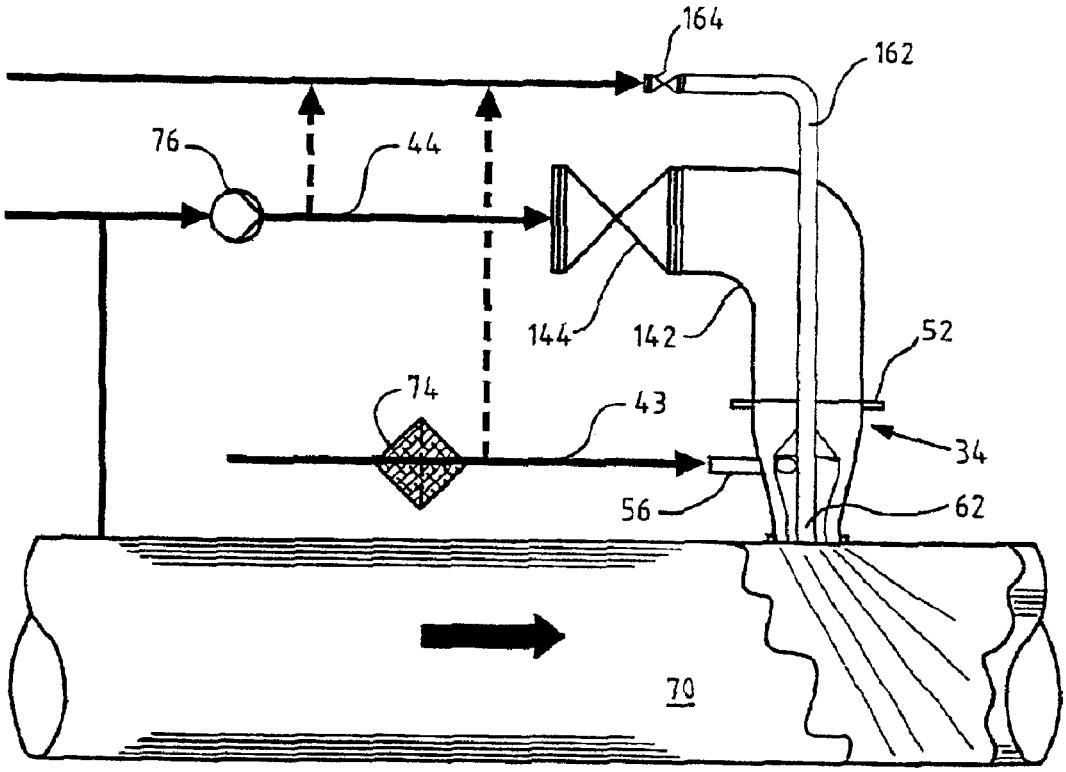

In the following, the method and apparatus according to the invention are disclosed in more detail with reference to the appended figures, where FIGS. 1*a*, 1*b* and 1*c* illustrate prior art retention aid feeding apparatuses, FIG. 2 illustrates a retention aid feeding process according to a preferred embodiment of the invention connected with the short circulation of a paper machine, FIG. 3 illustrates a retention aid feeding-/mixing apparatus according to a preferred embodiment of the invention, FIG. 4 illustrates a retention aid feeding-/mixing apparatus according to a second preferred embodiment of the invention, FIG. 5 illustrates a retention aid feeding-/mixing apparatus according to a third preferred embodiment of the invention, FIG. 6 illustrates an arrangement of a retention aid feeding-/mixing apparatus in connection with the fiber suspension flow channel according to a preferred embodiment of the invention, FIG. 7 illustrates an arrangement of a retention aid feeding-/mixing apparatus in connection with the fiber suspension flow channel according to a second preferred embodiment of the invention, FIGS. 8*a* and 8*b* illustrate an arrangement of a retention aid feeding-/mixing apparatus in connection with the fiber suspension flow channel according to a third preferred embodiment of the invention, FIG. 9 illustrates a detail of the retention aid feeding process of FIG. 2 according to a preferred embodiment of the invention, FIG. 10 illustrates an alternative to a detail of the retention aid feeding process of FIG. 9 according to a second preferred embodiment of the invention, and FIG. 11 illustrates an alternative to some details of the retention aid feeding process of FIGS. 9 and 10 according to a third preferred embodiment of the invention.

According to FIG. 1*a*, prior art feeding arrangement of retention aid comprises a fiber suspension flow channel 2 surrounded by an annular retention aid manifold 4, into which retention aid is introduced through conduit 5. Therefrom a number of feed pipes 6 (in the figure four feed pipes) lead to the flow channel 2, which feed pipes open into the flow channel 2 so that the retention aid from feed pipes 6 may freely flow into the fiber suspension. As already mentioned, the feeding according to prior art is carried out so that the chemical is allowed to flow into the fiber suspension at a relatively low pressure difference, whereby the final mixing is presumed to take place in a mixing apparatus, such as e.g. the headbox feed pump or the headbox screen. FIGS. 1*b* and 1*c* illustrate a second, alternative solution. In this solution, two retention aid feed pipes 16 are arranged inside flow channel 2, said feed pipes having feed holes or feed slots 18 in the area inside the flow channel. In the latter alternative, retention aid is more efficiently mixed with the flowing fiber suspension, because the retention aid may be proportioned also into the center of the flow.

FIG. 2 illustrates an arrangement of the short circulation of a paper machine partially according to both prior art and a preferred embodiment of the invention, mainly in view of retention aid introduction. In a process according to FIG. 2, the fiber suspension to be fed to the paper machine is diluted to applicable consistency in a wire pit 20 with white water from the paper machine 22, although a separate mixing tank may be utilized. Other adequate liquids may be used for dilution too, if desired, as for instance filtrate from a white water filter. From the wire pit 20, the fiber suspension is guided by means of a pump 24 to centrifugal cleaning 26 and further to a gas separation tank 28. Gas-free fiber suspension is pumped by means of a headbox feed pump 30 into a headbox screen 32, and after that in a feeding-/mixing apparatus 34 a retention aid is added into the fiber suspension prior to transporting the fiber suspension to the headbox 36 of the paper machine 22. The process arrangement described above may be considered as prior art.

In FIG. 2 there is also a schematic illustration of the treatment of a retention aid prior to the retention aid is fed into the fiber suspension. The retention aid in liquid or powder form is mixed into fresh water, clean water in order to avoid flocculation, in a container 40, wherefrom the retention aid solution is proportioned by means of a pump 42 directly into a feeding-/mixing apparatus 34. In arrangements according to prior art, the retention aid solution was either taken into a second mixing container where it was further diluted to a final concentration of about 0.05–0.1%, or the corresponding dilution was carried out in the flow channel. FIG. 2 shows further a pipe 44 leading from the wire pit 20 of the paper machine to the mixer 34. In other words, in an arrangement according to this embodiment, white water is applied from wire pit 20 into the mixer 34 for aiding in feeding the retention chemical into the fiber suspension flow, which white water thus contains fines filtrated off the fiber suspension through the wire. Naturally, for instance filtrate from white water filter or some other filtrate obtained from the process may be used as the feeding liquid. An additional possibility to dilute the retention chemical is shown in FIG. 2. It is a pipe 48, through which more clean water or fresh water may be introduced into the retention aid solution in order to dilute the solution, if desired.

FIG. 3 illustrates schematically a mixing apparatus according to a preferred embodiment of the invention. The mixing apparatus 34 according to FIG. 3 is, in fact, a nozzle comprising preferably an essentially conical casing 50, flanges 52 and 54 arranged into it and preferably, but not necessarily, placed at its opposite ends, and a conduit 56 for the retention chemical. The mixing apparatus 34 is connected via flange 52 to a feeding liquid pipe and via flange 54 to the fiber suspension flow channel. In the arrangement according to the fig., the casing 50 of the mixing apparatus 34 is converging from flange 52 towards flange 54 inside of which is the opening 58 of the mixing apparatus. A purpose of the conical form of the casing 50 is to accelerate the medium flow in the mixing apparatus 34 so that the velocity of the jet discharging from the mixing apparatus 34 into the fiber suspension flow is at least three times, but preferably about five times the velocity of the fiber suspension flow. This velocity difference ensures that the retention chemical jet penetrates quickly enough and deep enough into the fiber suspension flow to be mixed with the fiber suspension essentially more homogeneously than in prior art embodiments. In the embodiment according to FIG. 3, the retention chemical feeding conduit 56 is preferably tangential in order to ensure that retention aid discharging through opening 58 of the mixing apparatus 34 into the fiber suspension flow is distributed homogeneously at least on the whole periphery of the opening 58. At the same time, tangential feeding ensures that the retention chemical is mixed into the whip water under minimum possible shear forces in order to prevent the polymeric chains of the chemical from degrading.

FIG. 4 illustrates as an additional embodiment of the mixing apparatus 34 of FIG. 3 a hollow annular member 60 arranged centrally inside the mixing apparatus 34, into which member the retention aid is guided via conduit 56. In this embodiment, the member 60 essentially comprises two rotationally symmetrical shells 59 and 61 and possibly one end wall 62. Further, at the end of member 60, on the fiber suspension flow channel side, there is a preferably annular opening 64 provided, through which the retention chemical is allowed to be discharged into the fiber suspension. The retention chemical conduit 56 pierces the wall of the conical casing 50 of the mixing apparatus 34 and further leads via the annular space between the conical casing 50 and the member 60 into the member 60 through the outer shell 59, at the same time preferably carrying the member 60 in its place. In this embodiment, the inner shell 61 restricting the member 60 is cylindrical and forms or comprises a pipe 62, through which part of the feeding liquid flow i.e. whip water is allowed to discharge into the fiber suspension flow. In this embodiment, the retention aid flow guided tangentially into member 60 turns in form of a spiral flow towards its own annular opening 64, through which the retention aid is discharged as a fan-shaped jet into the fiber suspension together with the feeding liquid discharging in this embodiment both from outside the opening 64 through the annular opening 58, and from inside the opening 64 through pipe 62. An additional purpose of member 60 is to further throttle the cross-sectional flow area of the mixing apparatus in order to insure a sufficient velocity difference between the retention aid flow and the fiber suspension flow. A second purpose of member 60 is to enable the contact between the retention aid with the feeding liquid to take place essentially at the same time that the retention aid is being fed into the fiber suspension flow. Practical experiments have shown that the feeding liquid should be introduced no more than 30 cm's prior to the feeding of said feeding liquid and the retention aid into the fiber suspension flow. Preferably the feeding liquid should be introduced in connection with the retention aid within less than 20 cm's from the fiber suspension flow channel. The figure clearly shows that the retention aid need not necessarily be in any contact with the feeding liquid before it is discharged through its opening 64 into the fiber suspension flow channel.

FIG. 5 illustrates a retention aid feeding-/mixing apparatus according to a third preferred embodiment of the invention. In principle, the apparatus is exactly similar to the one of FIG. 4, but it clearly differs from previous apparatuses by both its coupling to the process and by its operational characteristics. In the apparatus of FIG. 5, the inner pipe 62 of member 60 is connected to the process via its own flow path 162 and the outer pipe of the apparatus 34, forming the wall of the conical casing 50, via its own flow path 144. Both flow paths 144 and 162 are provided with flow regulation devices 146 and 164, preferably valves. The flow pipe 144 functions as already stated before, but into the inner pipe 62 of member 60 it is now possible to introduce e.g. either clean water, some circulation water from the paper mill, white water, clear filtrate or some other non-clean liquid suitable for that purpose, even fiber suspension fed into the headbox. Further, through flow path 162 it is possible to introduce, if desired, a retention aid component, especially in question of a retention aid containing several components. As an example, a short-chain retention chemical might be mentioned, in case the retention aid is formed of a long-chain and a short-chain chemical. In that case, the long-chain chemical is supplied tangentially into member 60 earlier, through conduit 56 illustrated in FIGS. 3 and 4. That is, liquids introduced through flow paths 144 and 162 may be of similar or different character, depending on the application.

An advantage of separate feeding through flow path 162 is that by changing the amount of the feed, the effect of the liquid discharging from inner pipe 62 on the mixing of the chemical may be regulated. For instance, by introducing a large amount of liquid through inner pipe 62, the retention chemical is made to penetrate deeper into the fiber suspension flow. Accordingly, by feeding in a smaller amount of liquid through inner pipe 62, the penetration of the retention chemical is reduced, too.

Further, it is worth mentioning that in a solution according to both FIG. 4 and FIG. 5, the retention chemical feed is very gentle compared to prior art methods of retention chemical introduction. As the retention chemical in any case is formed of molecules composed of polymeric chains, these should be fed with additional water introduction as gently as possible, in order to prevent the very sensitive polymeric chains from breaking and, subsequently, in order to avoid a remarkable reduction in the effect of the retention chemical. When the chemical is supplied in the apparatuses according to FIGS. 4 and 5 as a fan-shaped jet into the water discharged through the annular opening 58, shearing forces between the water and the chemical solution are reduced to minimum. The desired functioning of the feeding-/mixing apparatus according to the invention is proved by the test results, which show that the utilization of the apparatus according to the invention improves wire retention by at least 10%. The only explanations for the advantageous test results are more precise and more efficient mixing of the chemical and reduction in the degradation of the polymeric chains of the chemical during the mixing.

As a further preferred embodiment of the apparatus according to the invention, the improvements made in the feeding-/mixing apparatuses of FIGS. 4 and 5 are worth mentioning. Our tests showed that the position of both the inner pipe 62 of member 60 and the outer shell 59 of member 60 in the axial direction of member 60 in relation to the end of the casing 50 of the feeding-/mixing apparatus 34 has an effect on the efficiency and accuracy of chemical mixing. Thus, in the most advanced version both said shells 59 and 61 are made separately movable in the axial direction of member 60. One possibility of doing this is to arrange the inner pipe 62 totally separate so that it slides along the inner surface of the inner shell 61 of member 60 and further in relation to the member 60 itself so that the member 60 slides in relation to the inner pipe 62. In that case it is, naturally, advantageous to supply the liquid into both the inner pipe 62 and the member 60 in their moving direction i.e. in the axial direction, whereby the liquid feed pipes (corresponding to conduit 56 and flow path 162 of FIG. 5) are arranged slidably sealed in relation to the member 60 and the inner pipe 62.

A further additional modification of the feeding-/mixing apparatus according to the invention is to arrange at the end of the inner pipe of member 60 or at the end of pipe 62 arranged inside member 60 a nozzle head which closes the opening of pipe 62 at the axis, leaving an essentially annular slot between itself and the rims of the pipe opening. This construction insures that the liquid jet discharging from pipe 62 is well-spreading and of essentially conical form.

FIG. 6 illustrates schematically a possible arrangement of the feeding-/mixing apparatuses 34 of FIG. 3 in connection with the fiber suspension feed pipe 70. In principle, this is carried out in a way demonstrated in FIG. 1*a*. The only difference from the prior art method according to FIG. 1*a*—excluding the feeding of feeding liquid into the mixing apparatus and the point that as feeding liquid something else than clean water is used—is, in practice that the retention chemical solution discharging from the mixing apparatus 34 is planned to penetrate so deep into the fiber suspension flow in the feed pipe 70 that the retention chemical is mixed practically into the whole fiber suspension flow.

FIG. 7 illustrates a second preferred method of feeding a retention chemical from the mixing apparatus 34 into the fiber suspension flow. In this embodiment, the mixing apparatuses 34 are arranged staggered opposite each other e.g. at the accept outlet 72 of the headbox screen or at another pipe of corresponding shape. The end of said outlet 72 facing the screen housing is arranged as essentially rectangular, from which point on, towards the feed pipe 70 leading to the headbox, it takes a round shape. The mixing apparatuses 34 are placed at the sidewalls of the outlet conduit 72 so that the retention aid jets discharging from the mixing apparatuses cover an essential part of the total cross section of conduit 72. Only at two corners of conduit 72 there is a small uncovered space left, which is not significant in respect of the mixing of the retention aid, as the fiber suspension flow when discharging from the screen is in such a heavy turbulence that the retention aid is mixed practically completely into the fiber suspension during the short interval available for that.

FIGS. 8*a* and 8*b* illustrate still a further alternative solution for the construction of a mixing apparatus according to the invention. The solution is mainly based on a round pipe according to FIG. 6, whereby there is a problem, especially in question of big pipes that liquid jets of mixing apparatuses penetrate into the pulp flow in a round pipe only to a restricted depth. Thus, jets from mixing apparatuses placed on the periphery of the pipe do not necessarily, in all circumstances, get into the center of the pipe, and the chemical is not mixed therein. And, if all jets from mixing apparatuses placed on the periphery of the pipe do get into the center of the pipe, the crossing areas may be subjected to chemical overdosing. The said problem has been avoided in the embodiment according to the figure by changing the shape of pipe 78 at the mixing point to be elliptical (preserving advantageously the same cross-sectional flow area). The mixing apparatuses 34 are placed on the periphery of the ellipse so that their jets are directed through the narrowest part of the ellipse, as shown in FIG. 8. In the embodiment according to the figure, the distance from the mixing apparatus 34 to the opposite side of pipe 78 is reduced by half compared to an analogous situation in a round pipe (FIG. 6). The amount and location of the mixing apparatuses 34 are chosen so that jets from the mixing apparatuses 34 form an essentially even cover on the cross section of the elliptic pipe 78. As advantages compared to a round pipe, it is worth mentioning that practically 100% of the pipe cross section is covered by the jets, and further the fact that in an elliptic pipe, just as in a rectangular pipe according to FIG. 7, overlapping, crossing jets are not formed. As a result, no local overdoses occur and neither passing through of untreated pulp, i.e. pulp which has not come to contact with the retention chemical. An elliptic flow channel is arranged separately in a longish direct pipeline, for example according to FIG. 8*b*, or e.g. the accept opening of the headbox screen is made elliptic or rectangular. FIG. 8*b* illustrates an arrangement of the mixing apparatus/es in an elliptic pipe section 78 between cylindrical pipe sections 80' and 80". Preferably the reshaping of the cross section of a pipe from elliptic to cylindrical and vise versa is performed so that the cross sectional area remains constant, which means that also the flow speed, accordingly, remains constant.

FIG. 9 illustrates the coupling of a mixing apparatus 34 fixed in a flow channel leading to the headbox with various pipelines. As seen already from FIGS. 3 and 4 and partly from FIG. 2, retention aid solution produced in a solution tank 40 (FIG. 2) is transported to conduit 56 of the mixing apparatus 34 through pipe 43. Pipe 43 is provided with a filter 74 for separating from the solution the insoluble materials possibly left therein. If desired, additional dilution water, preferably clean water, may be brought into the retention chemical solution through pipe 48. In this embodiment, that is illustrated to take place between filter 74 and the mixing apparatus, but it is naturally possible to introduce the additional dilution liquid into the upper-flow side of filter 74. This is not necessary, though. Additionally, a suitable feeding liquid is introduced into the mixing apparatus 34 through pipe 44 fixed on flange 52, which feeding liquid may be white water from the wire pit according to an embodiment of FIG. 2, clear or turbid filtrate or some other liquid suitable for the purpose.

FIG. 10 illustrates an alternative to the feeding liquid of FIGS. 2 and 9. FIG. 9 illustrates a minor side flow from feed pipe 70 into pipe 44, which side flow is fed at an increased pressure by means of a pump 76 into the mixing apparatus 34. In other words, as feeding liquid the same fiber suspension that is already being fed into the headbox is used.

FIG. 11 illustrates further the coupling of the feeding-/mixing apparatus of FIG. 5 with the rest of the process. The figure shows how white water from the wire pit, clear or turbid filtrate or some other liquid suitable for the purpose, or fiber suspension being fed to the headbox in principle exactly in accordance with FIGS. 9 and 10, is supplied into the apparatus through flow path 144. But, according to the embodiment of FIG. 5, the inner pipe 62 of member 60 of the apparatus 34 is connected to an outer flow path 162 which may lead either to a retention chemical solution tank 140, various sources of additional liquid, e.g. white water, clear or turbid filtrate etc., or to a source of clean liquid. Further the figure illustrates how both flow paths 144 and 162 are provided with valves 146 and 164 for regulating the liquid flow in said flow paths in a desired way.

As for the feeding-/mixing apparatus described above, one has to understand that, although it is most preferably operating and located when fastened directly in the flow channel wall, whereby the mixing of the retention chemical into the "whip water" may be carried out practically at the interface of the feeding-/mixing apparatus and the flow channel, it is, of course, possible to place the feeding-/mixing apparatus according to the invention further away from the fiber suspension flow channel. A precondition for this is, however, that all the liquids used in the mixing are clean waters, i.e. without suspended matters that the retention chemical might react with. In other words, by essentially increasing the consumption of clean water, the mixing of the retention chemical into the whip water may be arranged to take place further away from the fiber suspension flow channel leading to the headbox. At the same time, almost all advantages mentioned above may be obtained. The only disadvantage, apart from the increasing consumption of clean water, is a slightly harder treatment of the retention chemical in the stage when it is actually mixed into the fiber suspension.

When the mixing apparatus is placed further away from the fiber suspension flow channel, the retention aid has time enough to be completely mixed into to the so-called whip water, whereby, when this discharges into the fiber suspension flow duct, part of the retention chemicals is subjected to shearing forces strong enough to cause part of the polymeric chains to degrade and the retention chemical to possibly lose some of its effect.

Nevertheless, when the mixing of the retention chemical into the so-called whip water in the actual feeding-/mixing apparatus has been carried out gently, i.e. by feeding the retention chemical in a tangential flow through an annular opening 64 into the whip water discharging from an outer annular opening 58 at an exactly appropriate speed so that practically no injuriously great shear forces are generated between the liquids, the retention chemical is not damaged prior to the actual mixing into the fiber suspension, whereby practically the whole retention aid with its total effect is still usable when being mixed into the fiber suspension.

In addition to the embodiments described above, it is, (not shown) of course, possible to arrange a special mechanical mixer in connection with the mixing apparatus, by means of which mixer the retention chemical solution is mixed into the feeding liquid. When applying this method, a mixing apparatus according to FIGS. 3 and 4 with its tangential feeding of retention chemical is not necessarily needed. Accordingly, a high-pressure pump for transporting the retention chemical solution into the mixing apparatus is not necessarily needed, either, because the mechanical mixer that is used may be a mixer that increases the feeding pressure.

As may be seen from the above, a new method of feeding and mixing a retention chemical into fiber suspension flow has been developed. Referring to what has been stated here, one has to notice that the figures illustrate many different embodiments of the invention suitable to be used together depending on what is needed. Further, one has to notice that although the invention has been illustrated in the text only in connection with the mixing of retention chemicals in paper manufacturing, the invention may be utilized also in other connections demanding homogeneous and, at the same time, gentle mixing of a chemical into a liquid. Further one has to notice that none of the embodiments illustrated in the figures excludes the possibility that the arrangement to be applied and protected by the patent claims might be simpler than the entity illustrated in the figures. Thus, the field of application and the scope of protection of the invention are described by the appended patent claims only.

What is claimed is:

1. An apparatus for introducing a chemical into a process liquid comprising:

a process liquid flow channel for directing process liquid flow along a flow path;

an essentially hollow casing, said casing having a feeding liquid conduit for a feeding liquid, a chemical liquid conduit for a chemical liquid and at least one opening through which the chemical and feeding liquids are adapted to be discharged from said casing into said process liquid flow pipe, wherein said casing is attached to the process liquid flow channel in such a manner that said at least one opening is directed to discharge said feeding and chemical liquids substantially perpendicular to the flow path of said process liquid flow flowing in the process liquid flow channel, and wherein at least one of said feeding liquid conduit and said chemical liquid conduit opens at a close proximity of said at least one opening in such a manner that the chemical and the feeding liquids are allowed to contact substantially simultaneously with their discharge through said opening from said casing.

2. An apparatus according to claim 1, wherein said at least one of said feeding liquid conduit and said chemical liquid conduit opens inside said discharge opening.

3. An apparatus according to claim 1, wherein said at least one discharge opening includes at least two outlet openings for respectively separately discharging the chemical and the feeding liquids from said casing.

4. An apparatus according to claim 3, wherein one of said outlet openings is disposed inside another of said outlets.

5. An apparatus according to claim 4, wherein said outlet openings are concentric.

6. An apparatus according to claim 1, further comprising a member arranged inside the casing, said member forming a part of the chemical conduit, and having an outlet opening for discharging the chemical from the casing.

7. An apparatus according to claim 6, wherein said member is arranged inside the feeding liquid conduit.

8. An apparatus according to claim 6, further comprising an additional conduit for a third liquid, said additional conduit extending at a close proximity of said at least one discharge opening.

9. An apparatus according to claim 8, wherein said additional conduit is positioned centrally within said member.

10. An apparatus according to claim 8, wherein said additional conduit is arranged in flow communication with one of a source of another chemical, a source of clean water, a source of white water, a source of clear filtrate, a source of turbid filtrate, and a source of process liquid.

11. An apparatus according to claim 8, wherein said additional conduit extends centrally through said member up to a close proximity of said discharge opening.

12. An apparatus according to claim 1, wherein said feeding liquid conduit is formed of two parts, wherein one part of said feeding liquid conduit passes between said member and the casing, and the other part of said feeding liquid conduit passes through said member as a feeding liquid pipe.

13. An apparatus according to claim 12, wherein said chemical liquid conduit terminates in an annular outlet opening such that said feeding liquid pipe for the feeding liquid is positioned inside said annular opening.

14. An apparatus according to claim 13, wherein the annular chemical outlet opening is positioned between two feeding liquid discharge openings.

15. An apparatus according to claim 14, wherein said chemical outlet opening and said feeding liquid discharge openings are concentric.

16. An apparatus according to claim 1, further comprising a member arranged inside the casing by means of which a cross-sectional flow area of the flow path leading through the casing is decreased to increase the flow speed in the chemical introduction apparatus.

17. A system for introducing a chemical into a process liquid flow comprising:

a process flow pipe through which the process liquid flows, said process flow pipe having a pipe wall; and several chemical introduction apparatus, each chemical introduction aparatus being arranged on a periphery of said process flow pipe so as to be positioned oppositely relative to another chemical introduction apparatus so as to be in flow communication with the inside of the process liquid flow pipe and the process liquid flow therein; wherein each said chemical introduction apparatus comprises:

(i) an essentially hollow casing, said casing having a feeding liquid conduit for a feeding liquid, a chemical liquid conduit for a chemical liquid and at least one opening through which the chemical and feeding liquids are discharged from said casing into said process liquid flow pipe, wherein (ii) said casing is attached to the pipe wall of the process liquid flow pipe in such a manner that said at least one opening is directed to discharge said feeding and chemical liquids substantially perpendicular to said process liquid flow flowing in the process liquid flow pipe, and wherein (iii) at least one of said feeding liquid conduit and said chemical liquid conduit opens at a close proximity of said at least one opening in such a manner that the chemical and the feeding liquids are allowed to contact substantially simultaneously with their discharge through said opening from said casing.

18. The system according to claim 17, wherein said process liquid flow pipe is one of cylindrical, elliptical and rectangular shapes.

19. The system according to claim 17, further comprising a source of process liquid, wherein said feeding liquid conduit is arranged in flow communication with the source of process liquid for receiving the process liquid for use as feeding liquid.

20. The system according to claim 17, wherein the chemical introduction apparatus further comprises a member arranged inside the casing by means of which a cross-sectional flow area of the flow path leading through the casing is decreased to increase the flow speed in the chemical introduction apparatus.

21. The system according to claim 17, wherein the process liquid flow is a fiber suspension to be supplied to a paper machine having a headbox screen and a headbox, and wherein the chemical introduction apparatus is fixed to a duct leading from the headbox screen to the headbox of the paper machine so that said feed opening opens into said duct.

22. The system according to claim 17, wherein the process liquid flow is a fiber suspension to be supplied to a paper machine having a headbox screen provided with an accept conduit, and wherein said chemical introduction apparatus is fixed at the accept conduit of the headbox screen.

23. The system according to claim 17, wherein said feeding liquid is one of white water, clear or turbid filtrate, or fiber suspension being fed to the headbox.

24. The system according to claim 17, wherein a distance from the point of contact between the chemical and the feeding liquid to the process pipe for the process liquid flow is less than 30 centimeters.

* * * * *